US010364949B1

(12) United States Patent
Tang

(10) Patent No.: US 10,364,949 B1
(45) Date of Patent: Jul. 30, 2019

(54) ELONGATE LIGHT

(71) Applicant: Yi-Wen Tang, Taichung (TW)

(72) Inventor: Yi-Wen Tang, Taichung (TW)

( * ) Notice: Subject to any disclaimer, the term of this patent is extended or adjusted under 35 U.S.C. 154(b) by 0 days.

(21) Appl. No.: 15/994,689

(22) Filed: May 31, 2018

(51) Int. Cl.

| | |
|---|---|
| ***F21S 4/28*** | (2016.01) |
| ***F21K 9/20*** | (2016.01) |
| ***F21V 15/01*** | (2006.01) |
| ***F21V 21/00*** | (2006.01) |
| ***F21V 17/10*** | (2006.01) |
| ***F21S 4/22*** | (2016.01) |
| ***F21V 19/00*** | (2006.01) |
| *F21Y 115/10* | (2016.01) |

(52) U.S. Cl.
CPC ..... *F21S 4/28* (2016.01); *F21K 9/20* (2016.08); *F21S 4/22* (2016.01); *F21V 15/013* (2013.01); *F21V 17/10* (2013.01); *F21V 19/003* (2013.01); *F21V 21/00* (2013.01); *F21Y 2115/10* (2016.08)

(58) Field of Classification Search
None
See application file for complete search history.

(56) References Cited

U.S. PATENT DOCUMENTS

2015/0252965 A1* 9/2015 Edwards ..... B29C 48/20 362/84
2017/0198881 A1* 7/2017 McCreary, Jr. ..... F21V 7/0008

* cited by examiner

*Primary Examiner* — Ashok Patel
(74) *Attorney, Agent, or Firm* — Muncy, Geissler, Olds & Lowe, P.C.

(57) ABSTRACT

An elongate light includes a main body, being an extruded flexible plastic member, including a frame portion, a base board and two wing portions which are integrally formed of one piece. A longitudinal direction of the main body is defined as a first direction. The base board and the frame portion are connected to form a tubular structure. The two wing portions extend outwardly from two sides of the base board toward a direction away from the frame portion. A side of the base board away from the frame portion has at least one lighting element.

10 Claims, 8 Drawing Sheets

ELONGATE LIGHT

BACKGROUND OF THE INVENTION

Field of the Invention

The present invention relates to an elongate light.

Description of the Prior Art

Generally, a conventional lighting includes a housing, a shielding body and a lighting element. The lighting element is disposed in the housing and the shielding body is covered on the housing so that the lighting element is not exposed to the external environment. The elongate light disclosed by TWM530911 is the type described above.

However, the housing of the conventional lighting is a metal frame which is costly. Since the weight of the metal frame is heavy, it causes a considerable weight load to an object on which the metal frame is screwed or hanged. In addition, the shielding body needs to be additionally assembled to the housing, which results in a complicated assembling process.

The present invention is, therefore, arisen to obviate or at least mitigate the above-mentioned disadvantages.

SUMMARY OF THE INVENTION

The main object of the present invention is to provide an elongate light with low manufacturing cost, light weight and one-piece configuration.

To achieve the above and other objects, an elongate light is provided, including: a main body, being an extruded flexible plastic member, a base board and two wing portions which are integrally formed of one piece, a longitudinal direction of the main body being defined as a first direction, the base board and the frame portion being loopingly connected, the two wing portions extending outwardly from two sides of the base board toward a direction away from the frame portion, a side of the base board away from the frame portion having at least one lighting element, a distance between two ends of the two wing portions away from each other being defined as a first length, a projection of the frame portion on the first length being defined as a second length, the first length being larger than the second length.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
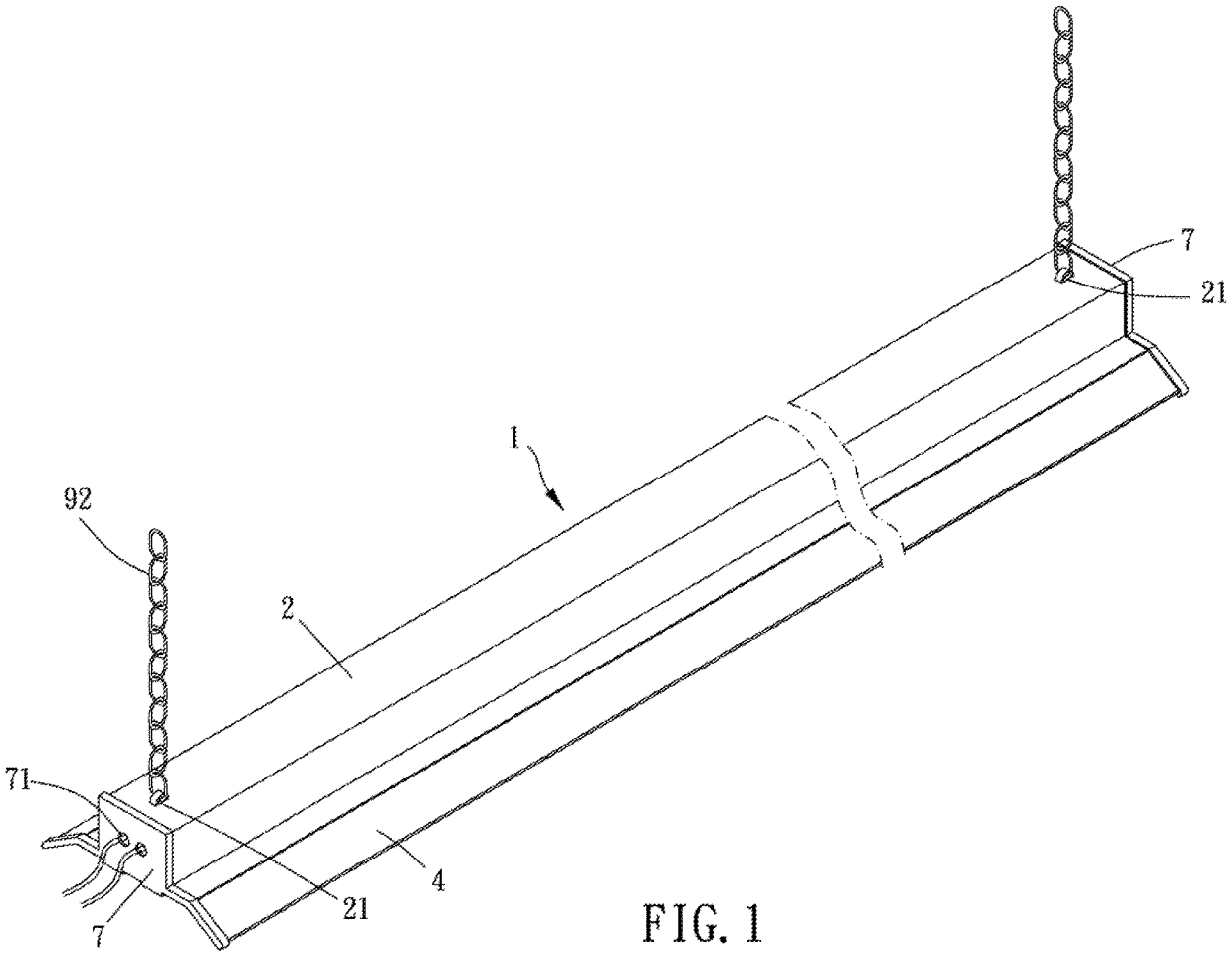
FIG. 1 is a stereogram of a first preferable embodiment of the present invention.
Figure 2:
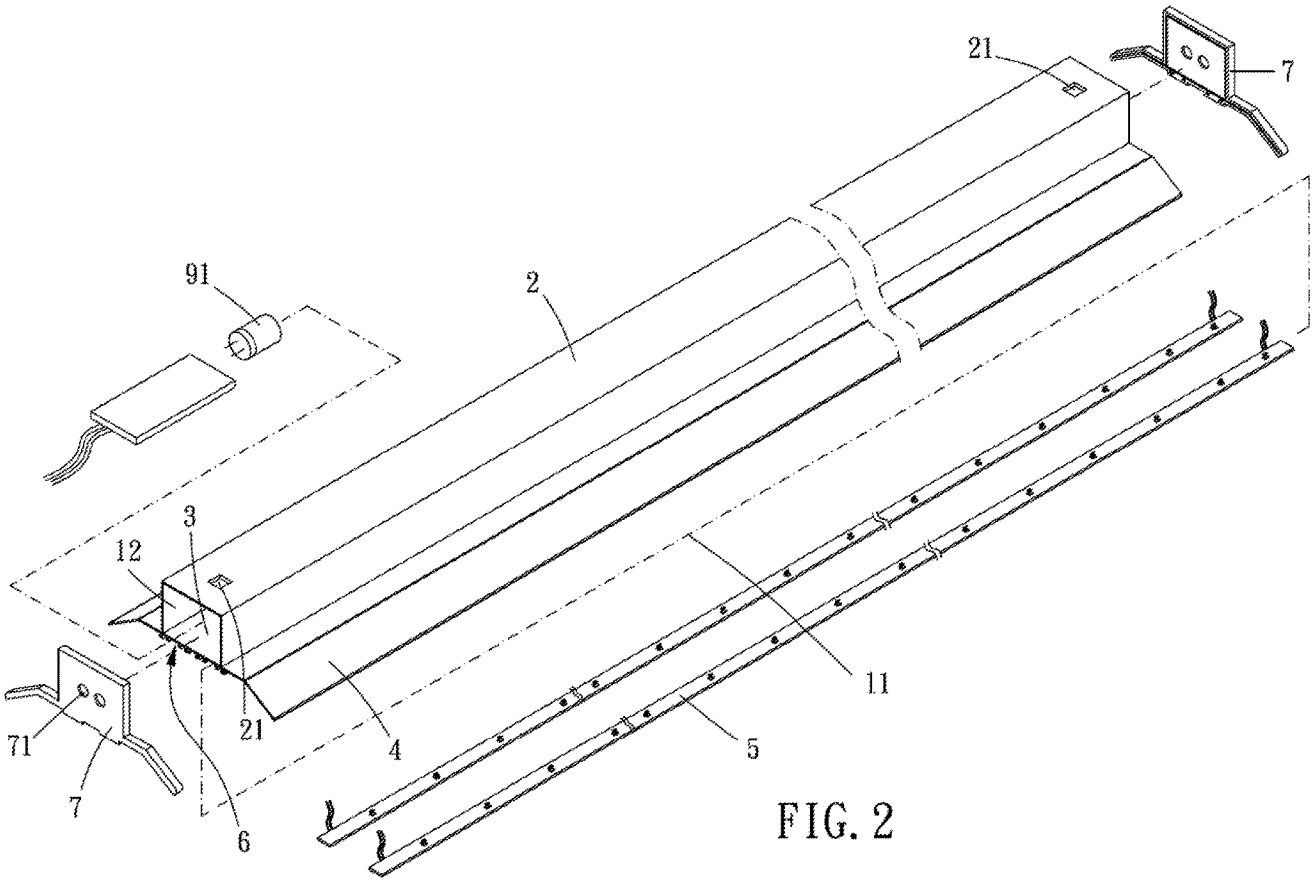
FIG. 2 is a breakdown drawing of the first preferable embodiment of the present invention.
Figure 3:
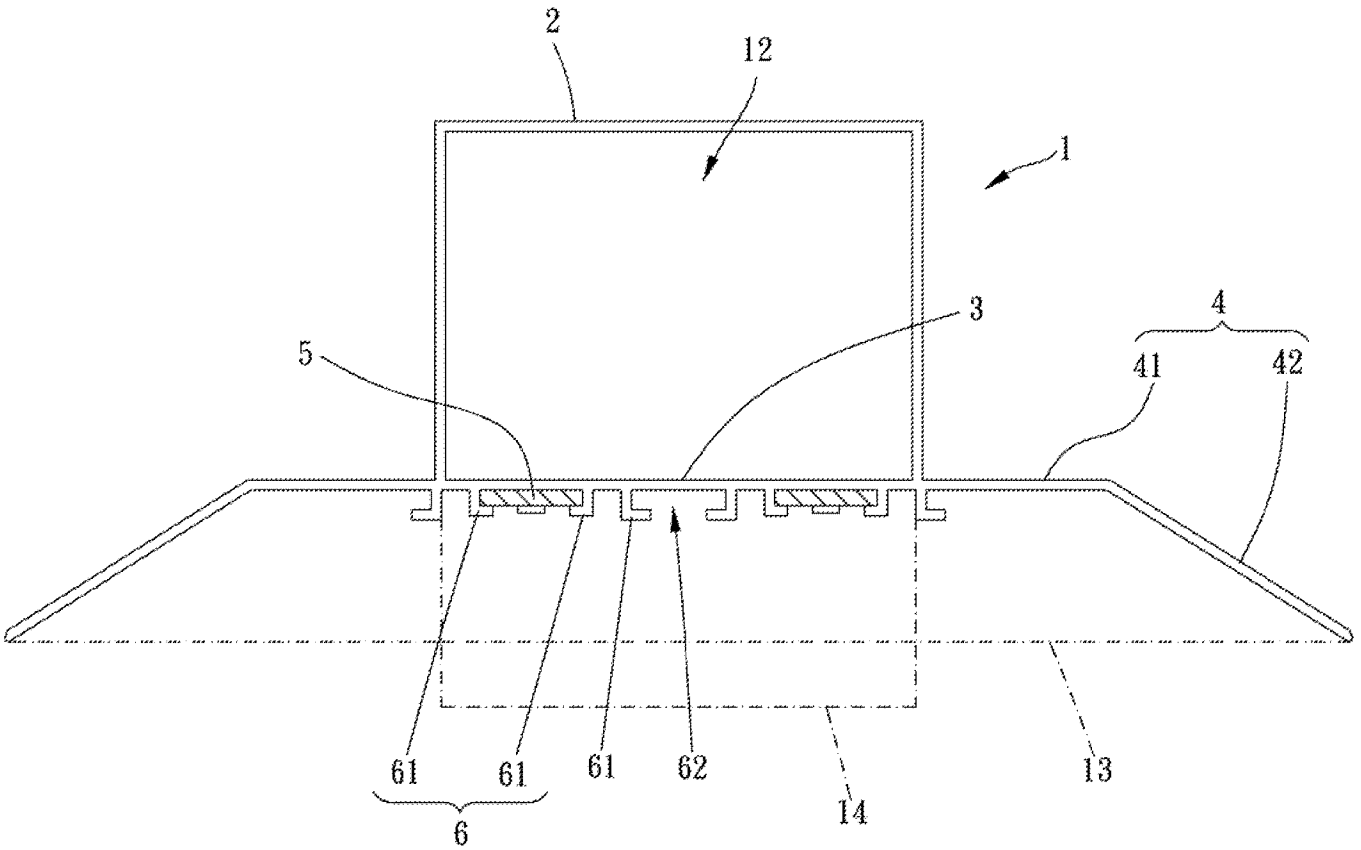
FIG. 3 is a side view of the first preferable embodiment of the present invention.

Please refer to FIGS. 1 to 3 for a first preferable embodiment of the present invention. An elongate light of the present invention includes a main body 1, being an extruded flexible plastic member, including a frame portion 2, a base board 3 and two wing portions 4 which are integrally formed of one piece. The main body 1 is flexible, thus avoiding damage due to external force and being durable. The main body 1 is of low manufacturing cost and light weight by plastic extrusion molding. A longitudinal direction of the main body 1 is defined as a first direction 11. The base board 3 and the frame portion 2 are connected to form a tubular structure. The two wing portions 4 extending outwardly from two sides of the base board 3 toward a direction away from the frame portion 2. A side of the base board 3 away from the frame portion 2 has at least one lighting element 5. A distance between two ends of the two wing portions 4 away from each other is defined as a first length 13. A projection of the frame portion 2 on the first length 13 is defined as a second length 14. The first length 13 is larger than the second length 14.

Specifically, the side of the base board 3 away from the frame portion 2 has at least one embedment portion 6. In this embodiment, there are two of the embedment portions 6 and two of the lighting elements 5. Each of the embedment portions 6 includes two leg portions 61 which are opposite to each other and define an embedment groove 62 therebetween, and each of the lighting elements 5 is embedded within one of the embedment groove 62. Each of the lighting elements 5 is LED strip for power saving. The main body 1 includes a hollow portion 12 which is defined between the frame portion 2 and the base board 3. The hollow portion 12 receives a power starter 91 which is electrically communicated with the two lighting elements 5.

In this embodiment, the base board 3 is a plate. Each of the wing portions 4 includes a transitional section 42 and a flat section 41 connected between the transitional section 42 and the base board 3. The first length 13 is 1.5 to 3 times the second length 14. In this embodiment, the first length 13 is 2 times the second length 14. The two wing portions 4 can reflect light emitted from the two lighting elements 5 toward the same direction to converge the light.

Preferably, the frame portion 2 is inverted U-shaped. The frame portion 2 and the base board 3 are annularly connected to include a rectangular cross-sectional profile. The frame portion 2 and the base board 3 are integrally formed of one piece so as to effectively increase a structural strength of the base board 3, and the base board 3 is able to carry the two lighting elements 5 and the power starter 91.

The elongate light further includes two covering portions 7. The two covering portions 7 are covered at two ends of the main body 1 which are located on the first direction 11. A shape of each of the two covering portions 7 corresponds to a shape of a cross-sectional profile of the main body 1 so that the two covering portions 7 can sufficiently cover the hollow portion 12 and avoid dust. The covering portion 7 further have at least one through hole 71. In this embodiment, a number of the at least one through hole 71 is two and the two through holes 71 are configured for conductive wires connected to the power starter 91 to penetrate therethrough. A side of the frame portion 2 away from the base board 3 further has at least one through mounting hole 21. In this embodiment, a number of the at least one through mounting hole 21 is two and the two through mounting holes 21 are configured to be assembled with a hanging member 92 (such as chains).

Figure 4:
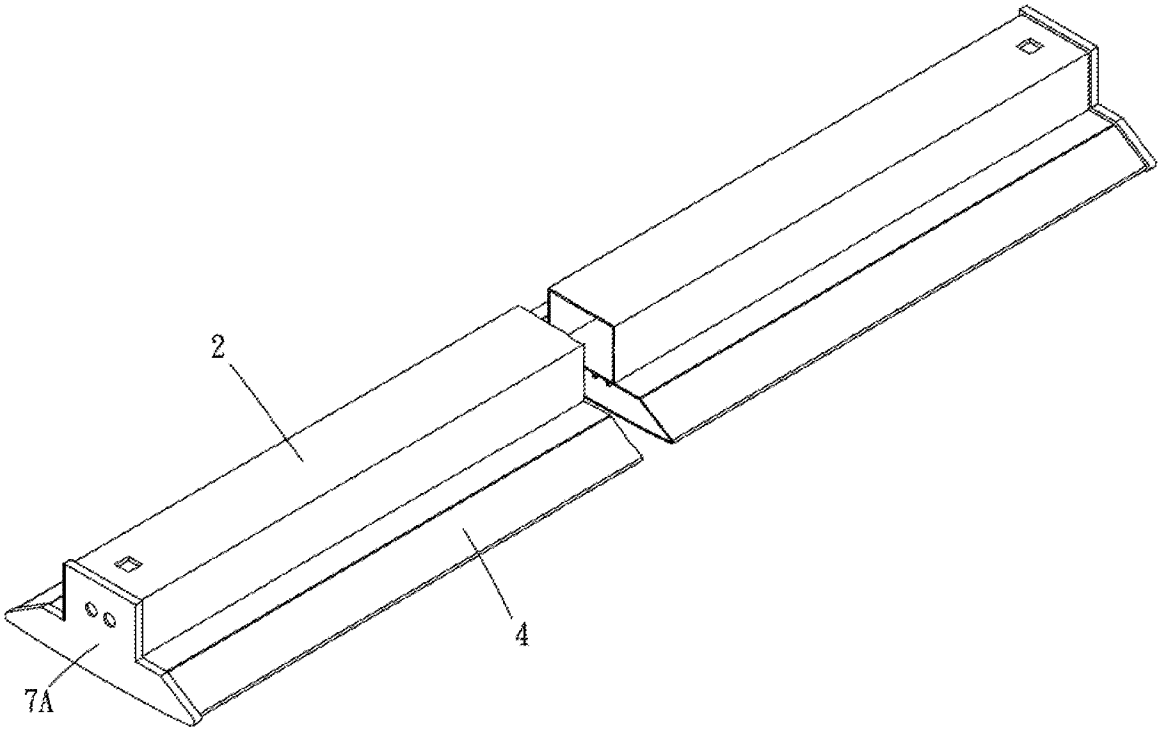
FIG. 4 is a stereogram of a second preferable embodiment of the present invention.
Figure 5:
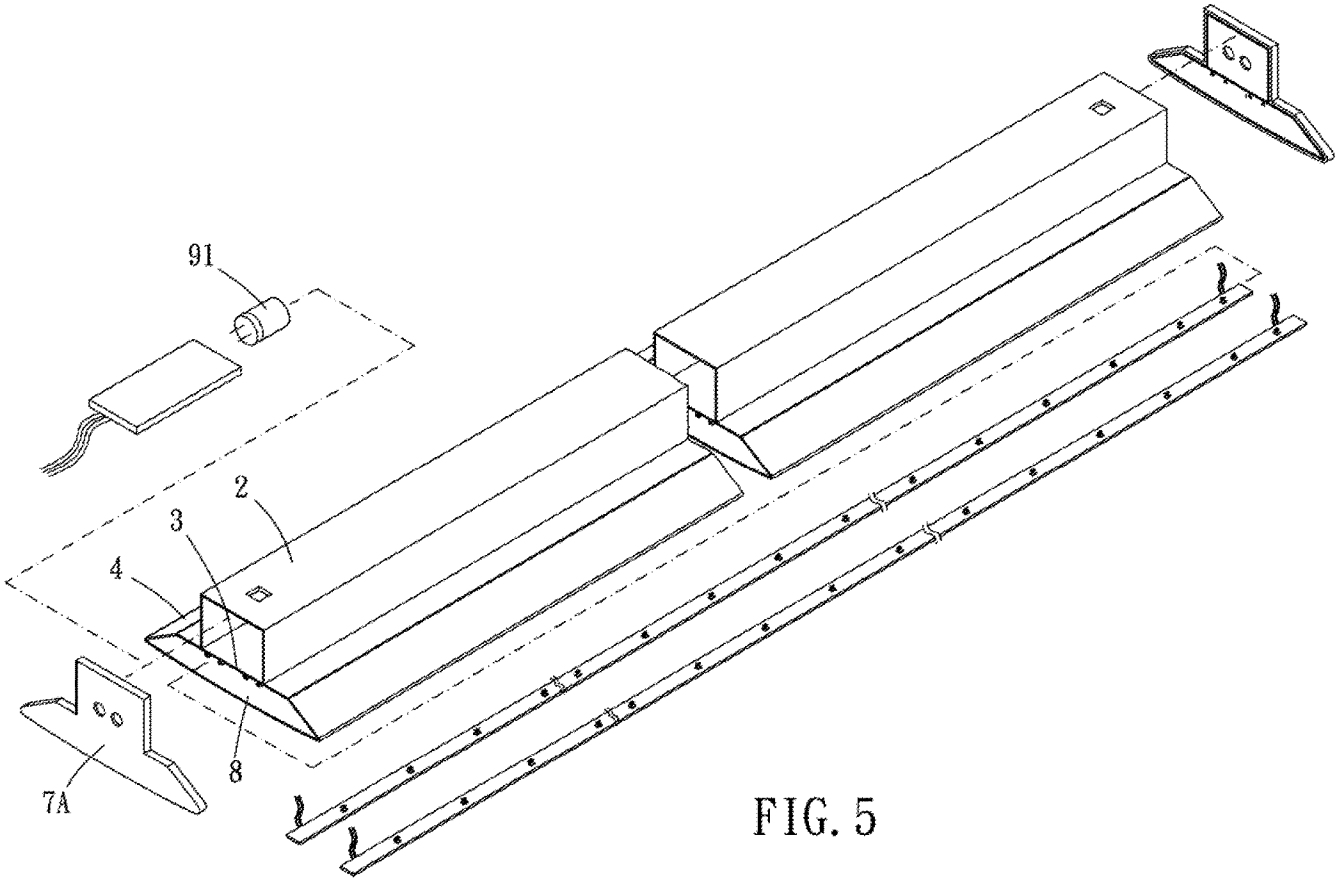
FIG. 5 is a breakdown drawing of the second preferable embodiment of the present invention.
Figure 6:
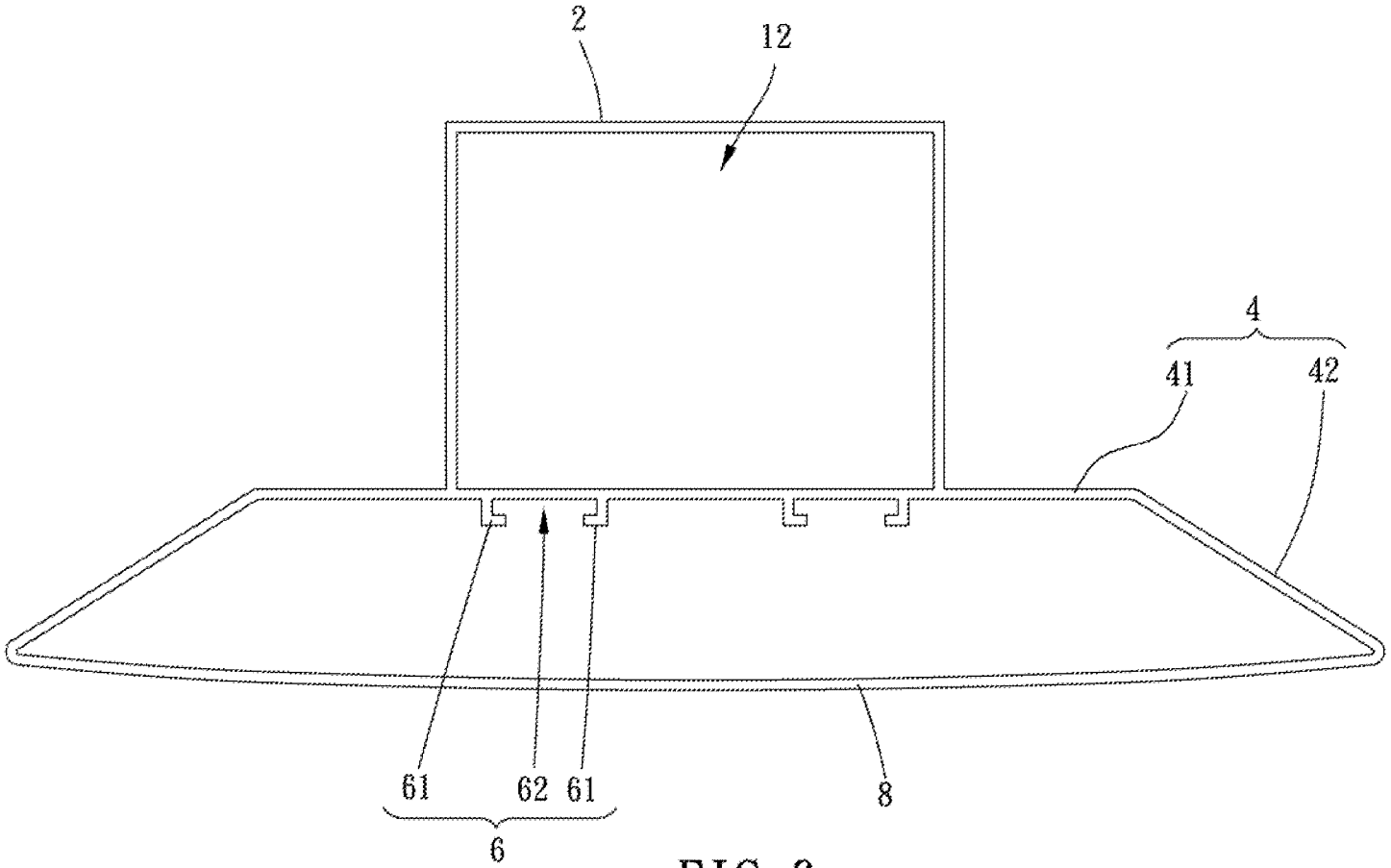
FIG. 6 is a side view of the second preferable embodiment of the present invention.

FIGS. 4 to 6 show a second embodiment of the present invention. The elongate light further includes a light-permeable shielding portion 8. Two ends of the shielding portion 8 are integrally connected to two ends of the two wing portions 4, and the shielding portion 8 shields the two lighting elements. A shape of each of the covering portions 7A also corresponds to a shape of a cross-sectional profile of the shielding portion 8. The shielding portion 8 provides softer light and avoids harsh light of the two lighting elements. Furthermore, the shielding portion 8 can protect the two lighting elements from damage due to external factors.

Figure 7:
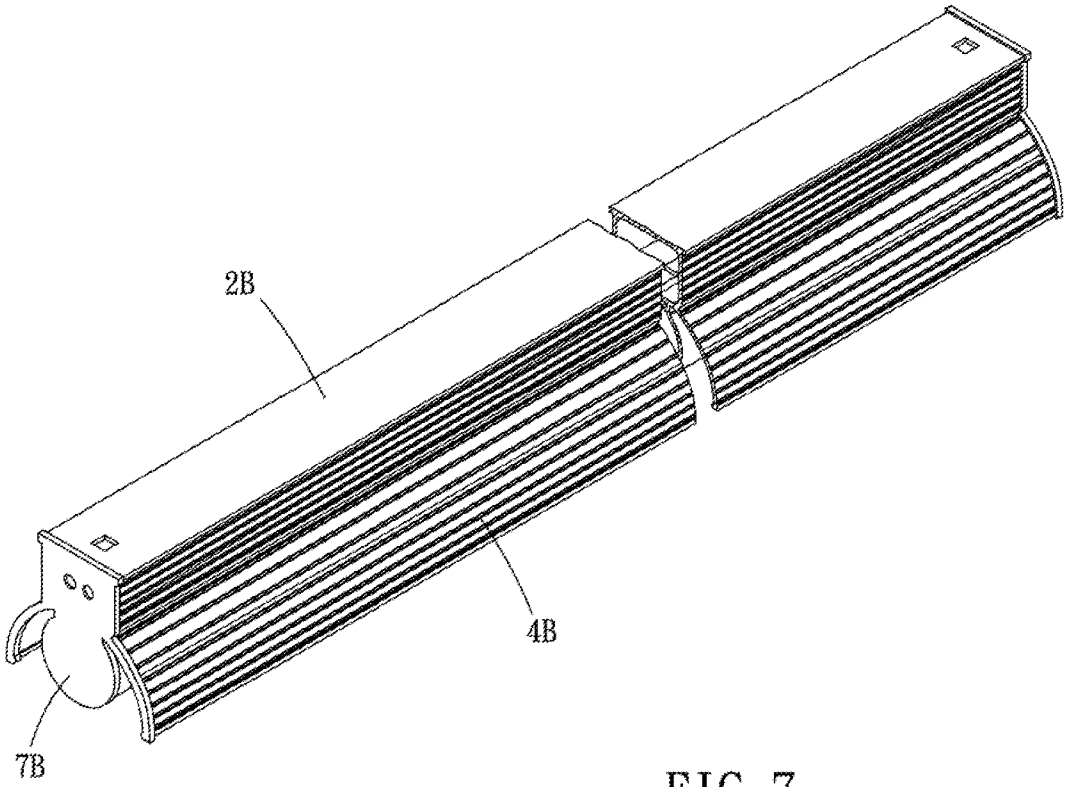
FIG. 7 is a stereogram of a third preferable embodiment of the present invention.
Figure 8:
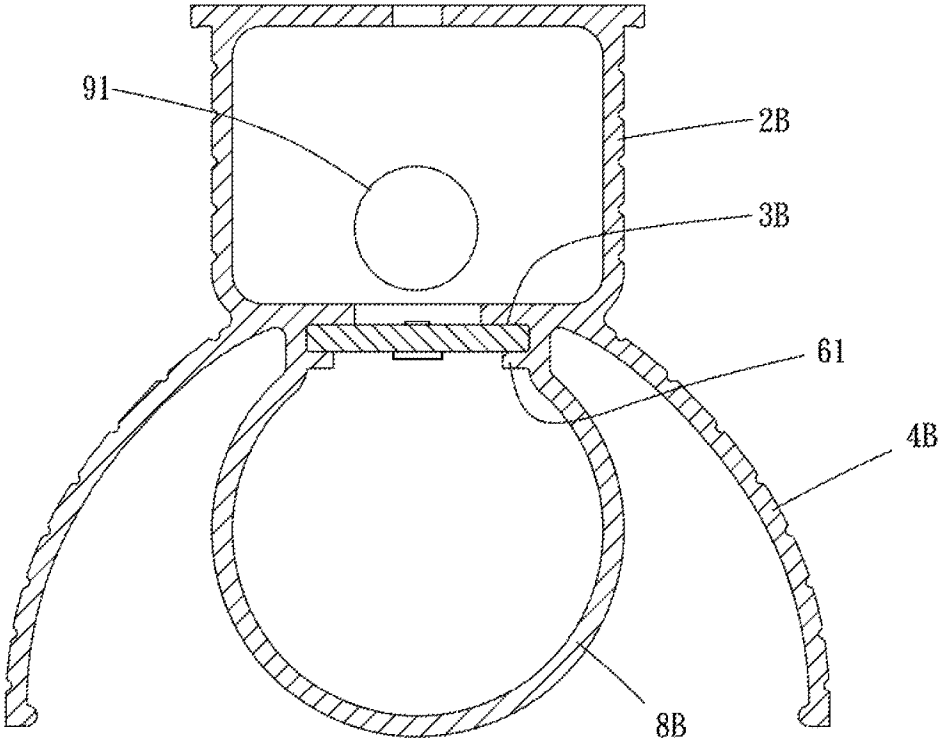
FIG. 8 is a side view of the third preferable embodiment of the present invention.

FIGS. 7 to 8 show a third embodiment of the present invention. Two ends of the shielding portion 8B are integrally connected to a side of the base board 3B away from the frame portion 2B and shield the two lighting elements. The two wing portions 4B are curved plates and concave surfaces of the two wing portions 4B face to each other. In this embodiment, the shielding portion 8B has a c-shaped cross-sectional profile. A shape of each of the covering portions 7B also corresponds to outer contours of the two wing portions 4B and the shielding portion 8B. In another embodiment, the shielding portion and the two wing portions may be other shapes according to actual requirements.

In summary, the main body is flexible, thus avoiding damage due to external force and being durable. The main body is of low manufacturing cost and light weight by plastic extrusion molding. The two wing portions can reflect the light emitted from the two lighting elements toward the same direction to converge the light.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An elongate light, including:

a main body, being an extruded flexible plastic member, including a frame portion, a base board and two wing portions which are integrally formed of one piece, a longitudinal direction of the main body being defined as a first direction, the base board and the frame portion being connected to form a tubular structure, the two wing portions extending outwardly from two sides of the base board toward a direction away from the frame portion, a side of the base board away from the frame portion having at least one lighting element, a distance between two ends of the two wing portions away from each other being defined as a first length, a projection of the frame portion on the first length being defined as a second length, the first length being larger than the second length.

2. The elongate light of claim 1, wherein the side of the base board away from the frame portion has at least one embedment portion, each of the at least one embedment portion includes two leg portions which are opposite to each other and define an embedment groove therebetween, and each of the at least one lighting element is embedded within one of the embedment groove.

3. The elongate light of claim 1, wherein each of the at least one lighting element is LED strip.

4. The elongate light of claim 1, wherein the base board is a plate, each of the two wing portions includes a transitional section and a flat section connected between the transitional section and the base board.

5. The elongate light of claim 1, wherein the frame portion is inverted U-shaped, and the frame portion and the base board are annularly connected to include a rectangular cross-sectional profile.

6. The elongate light of claim 1, further including two covering portions, wherein the two covering portions are covered at two ends of the main body which are located on the first direction, and a shape of each of the two covering portions corresponds to a shape of a cross-sectional profile of the main body.

7. The elongate light of claim 6, wherein the covering portions further have at least one through hole, and a side of the frame portion away from the base board further has at least one through mounting hole.

8. The elongate light of claim 1, wherein the first length is 1.5 to 3 times the second length.

9. The elongate light of claim 1, further including a light-permeable shielding portion, two ends of the shielding portion are integrally connected to two ends of the two wing portions, and the shielding portion shields the at least one lighting element.

10. The elongate light of claim 1, further including a light-permeable shielding portion, wherein two ends of the shielding portion are integrally connected to a side of the base board away from the frame portion, the shielding portion shields the at least one lighting element, the two wing portions are curved plates and concave surfaces of the two wing portions face to each other, and the shielding portion has a c-shaped cross-sectional profile.

* * * * *